US008308086B2

(12) United States Patent
Micheli et al.

(10) Patent No.: US 8,308,086 B2
(45) Date of Patent: Nov. 13, 2012

(54) AIRLESS SPRAY GUN HAVING A REMOVABLE VALVE CARTRIDGE

(76) Inventors: Paul R. Micheli, Glen Ellyn, IL (US); Nekheel Gajjar, Chicago, IL (US)

( * ) Notice: Subject to any disclaimer, the term of this patent is extended or adjusted under 35 U.S.C. 154(b) by 616 days.

(21) Appl. No.: 12/119,133

(22) Filed: May 12, 2008

(65) Prior Publication Data

US 2009/0277976 A1 Nov. 12, 2009

(51) Int. Cl.
*B05B 7/02* (2006.01)
*B05B 1/30* (2006.01)
*B05B 1/00* (2006.01)

(52) U.S. Cl. ..... 239/526; 239/569; 239/582.1; 239/600

(58) Field of Classification Search ..... 239/525–528, 239/587.1, 583, 569, DIG. 14, 600
See application file for complete search history.

(56) References Cited

U.S. PATENT DOCUMENTS

| | | | | |
|---|---|---|---|---|
| 2,416,719 | A | 3/1947 | Stockdale | |
| 2,519,283 | A | 8/1950 | Pulver | |
| 2,724,615 | A | 11/1955 | Guido | |
| 2,936,959 | A * | 5/1960 | Nord et al. | 239/127 |
| 2,961,335 | A | 11/1960 | Shepard | |
| 2,969,926 | A | 1/1961 | Peeps | |
| 2,991,940 | A | 7/1961 | Dupler et al. | |
| 3,181,798 | A | 5/1965 | Williams et al. | |
| 3,366,337 | A * | 1/1968 | Brooks et al. | 239/414 |
| 3,844,487 | A | 10/1974 | Malec | |
| 3,915,388 | A * | 10/1975 | Nathan | 239/415 |
| 4,022,381 | A * | 5/1977 | Karliner | 239/126 |
| 4,108,382 | A | 8/1978 | Ryd et al. | |
| 4,181,261 | A | 1/1980 | Crum | |
| 4,660,774 | A | 4/1987 | Kwok et al. | |
| 5,224,686 | A * | 7/1993 | Pacht | 251/282 |
| 5,765,753 | A | 6/1998 | Kieffer | |
| 5,887,793 | A | 3/1999 | Kieffer | |
| 5,975,429 | A * | 11/1999 | Jezek | 239/124 |
| 6,000,637 | A | 12/1999 | Duncan | |
| 6,019,294 | A | 2/2000 | Anderson et al. | |
| 6,412,516 | B1 * | 7/2002 | Goldsmith | 137/454.6 |
| 6,460,787 | B1 | 10/2002 | Hartle et al. | |
| 6,659,373 | B1 | 12/2003 | Heren et al. | |
| 6,702,198 | B2 | 3/2004 | Tam et al. | |
| 6,719,212 | B1 | 4/2004 | Leisi | |
| 6,854,667 | B2 | 2/2005 | Ulrich et al. | |

(Continued)

FOREIGN PATENT DOCUMENTS

| | | |
|---|---|---|
| EP | 0804969 | 11/1997 |

(Continued)

OTHER PUBLICATIONS

Carbin Wikipedia Reference.

*Primary Examiner* — Len Tran
*Assistant Examiner* — Justin Jonaitis
(74) *Attorney, Agent, or Firm* — Fletcher Yoder P.C.

(57) ABSTRACT

A system, in one embodiment, includes a spray gun having a body, a receptacle disposed in the body, and a valve cartridge. The valve cartridge includes a biasing member, a valve seat, a seal, and a valve member disposed through the seal and biased toward the valve seat via the biasing member. The valve member is movable between an open position and a closed position in a direction generally crosswise to a spray exit.

27 Claims, 9 Drawing Sheets

U.S. PATENT DOCUMENTS

| | | | | |
|---|---|---|---|---|
| 6,874,702 | B2 | 4/2005 | Turnbull | |
| 6,880,803 | B2 | 4/2005 | Kassulat et al. | |
| 7,032,839 | B2 | 4/2006 | Blette et al. | |
| 7,083,120 | B2 | 8/2006 | Gilpatrick et al. | |
| 7,296,780 | B1 * | 11/2007 | Hung | 251/121 |
| 7,472,842 | B2 | 1/2009 | Gilpatrick et al. | |
| 2004/0195383 | A1 * | 10/2004 | Amaduzzi | 239/526 |
| 2005/0189445 | A1 | 9/2005 | Hartle et al. | |
| 2006/0118661 | A1 | 6/2006 | Hartle et al. | |
| 2007/0221762 | A1 | 9/2007 | Micheli et al. | |
| 2008/0296409 | A1 | 12/2008 | Micheli | |
| 2009/0302133 | A1 | 12/2009 | Micheli et al. | |

FOREIGN PATENT DOCUMENTS

| | | |
|---|---|---|
| FR | 2351713 | 12/1977 |
| WO | WO9952642 | 10/1999 |
| WO | WO0166261 | 9/2001 |

* cited by examiner

AIRLESS SPRAY GUN HAVING A REMOVABLE VALVE CARTRIDGE

BACKGROUND

The invention relates generally to spray coating systems and, more particularly, to an airless spray coating device with a removable valve cartridge.

A typical spray coating device, such as a spray gun, includes a variety of discrete components, such as fluid valves, springs, conduits, and so forth. These discrete components are individually and/or sequentially assembled into a body of the spray coating device. Unfortunately, the discrete nature of these components increases the time and costs associated with manufacture, assembly, maintenance, and cleaning of the spray coating device. If a specific component becomes worn, then the maintenance process can be time consuming and expensive due the numerous discrete components assembled along with the worn component. For example, the coating fluid may eventually wear the components (e.g., valves, seals, etc.) in the fluid path through the spray coating device. Unfortunately, maintenance may involve sequentially removing and replacing a large number of discrete parts, thereby resulting in undesirable downtime. The downtime is particularly undesirably in automated systems, such as assembly lines. Without the maintenance, the spray coating device may produce undesirable spray patterns, non-uniform color distribution, leakage, clogging, and so forth.

BRIEF DESCRIPTION

A system, in one embodiment, includes a spray gun having a body, a receptacle disposed in the body, and a valve cartridge. The valve cartridge includes a biasing member, a valve seat, a seal, and a valve member disposed through the seal and biased toward the valve seat via the biasing member. The valve member is movable between an open position and a closed position in a direction generally crosswise to a spray exit.

DRAWINGS

These and other features, aspects, and advantages of the present invention will become better understood when the following detailed description is read with reference to the accompanying drawings in which like characters represent like parts throughout the drawings, wherein.

Figure 9:
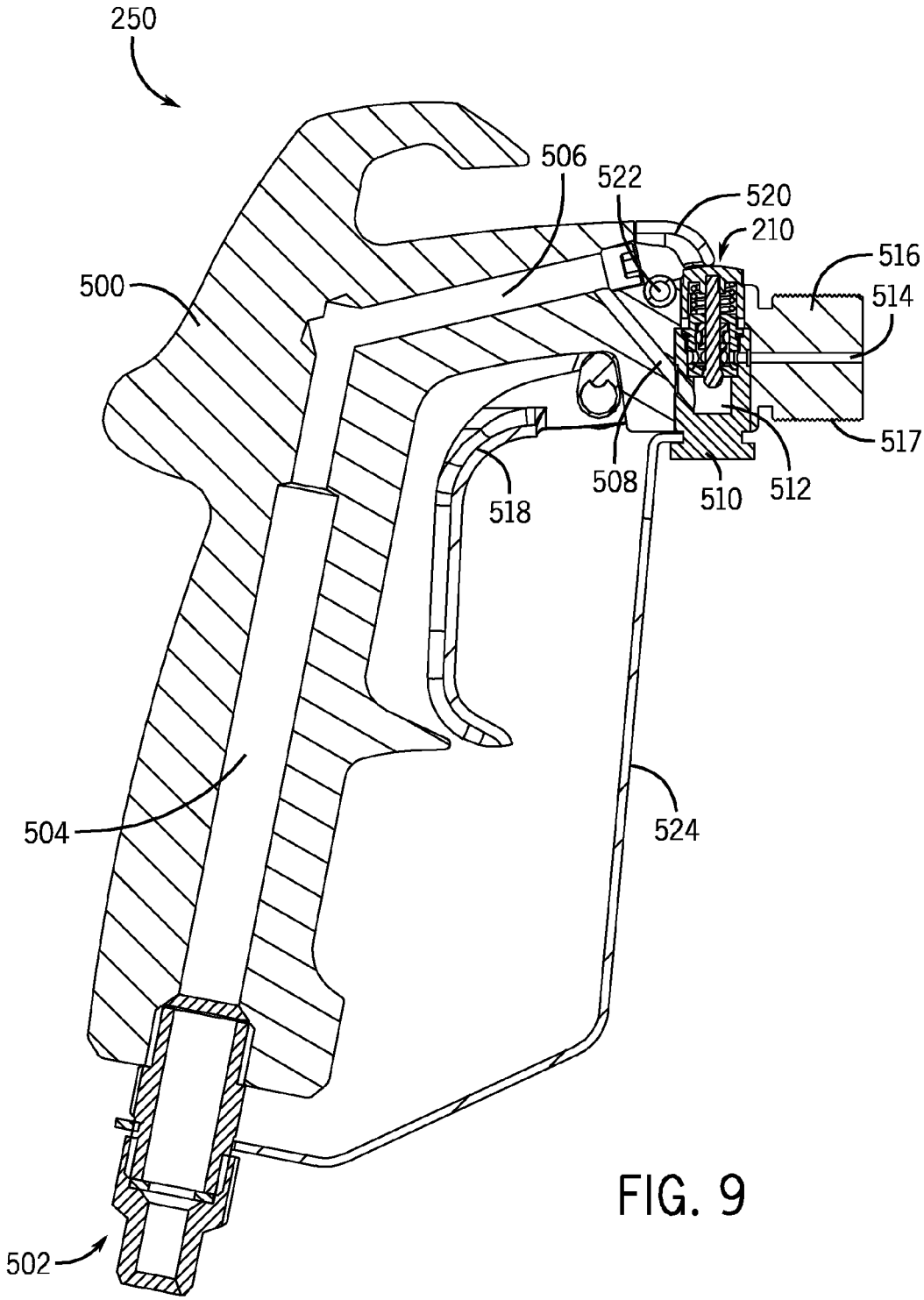
FIG. 9 is a cross-sectional side view of another embodiment of a spray coating device, such as an airless spray coating device used in the spray coating system and process as shown in FIGS. 1 and 2.
Figure 11:
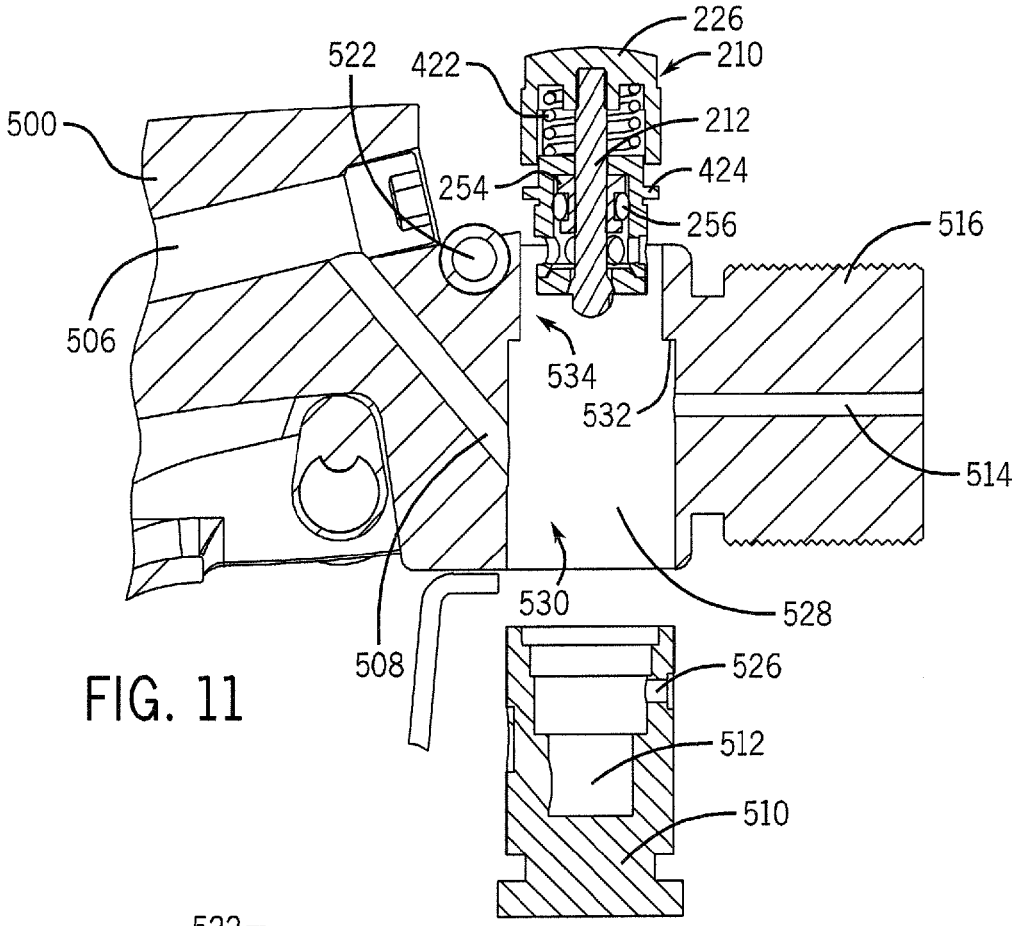
Figure 12:
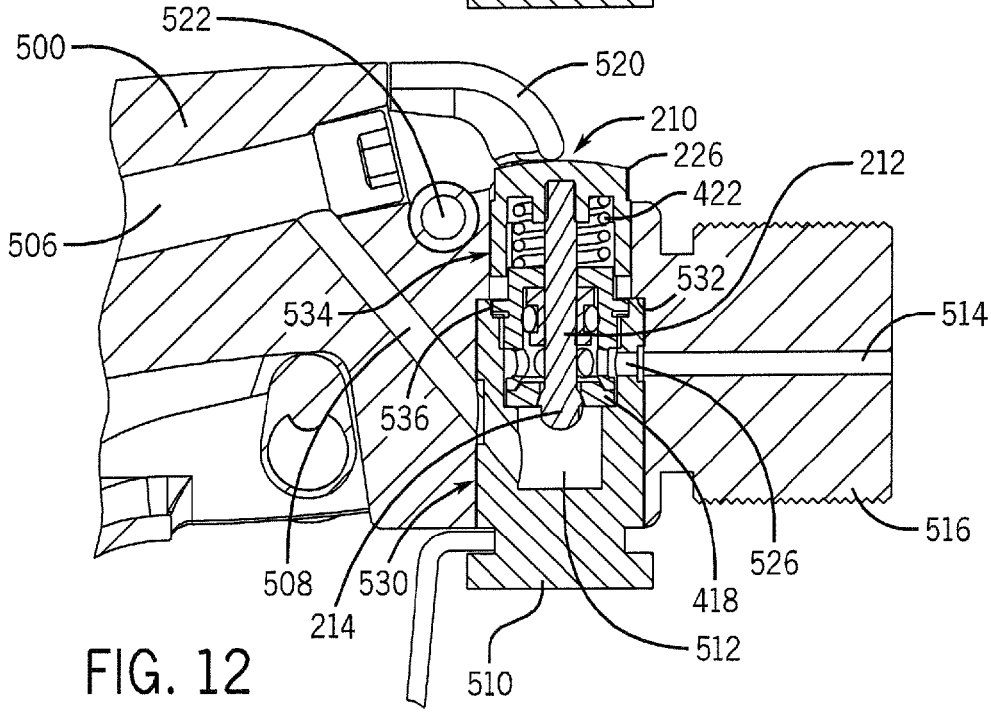

FIG. 11 is a cross-sectional side view of an embodiment of a valve cartridge of the spray coating device as shown in FIG. 9, wherein the valve cartridge is shown above a cavity in the spray coating device; and FIG. 12 is a cross-sectional side view of an embodiment of a valve cartridge of the spray coating device as shown in FIG. 9, wherein the valve cartridge is shown installed in the spray coating device.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
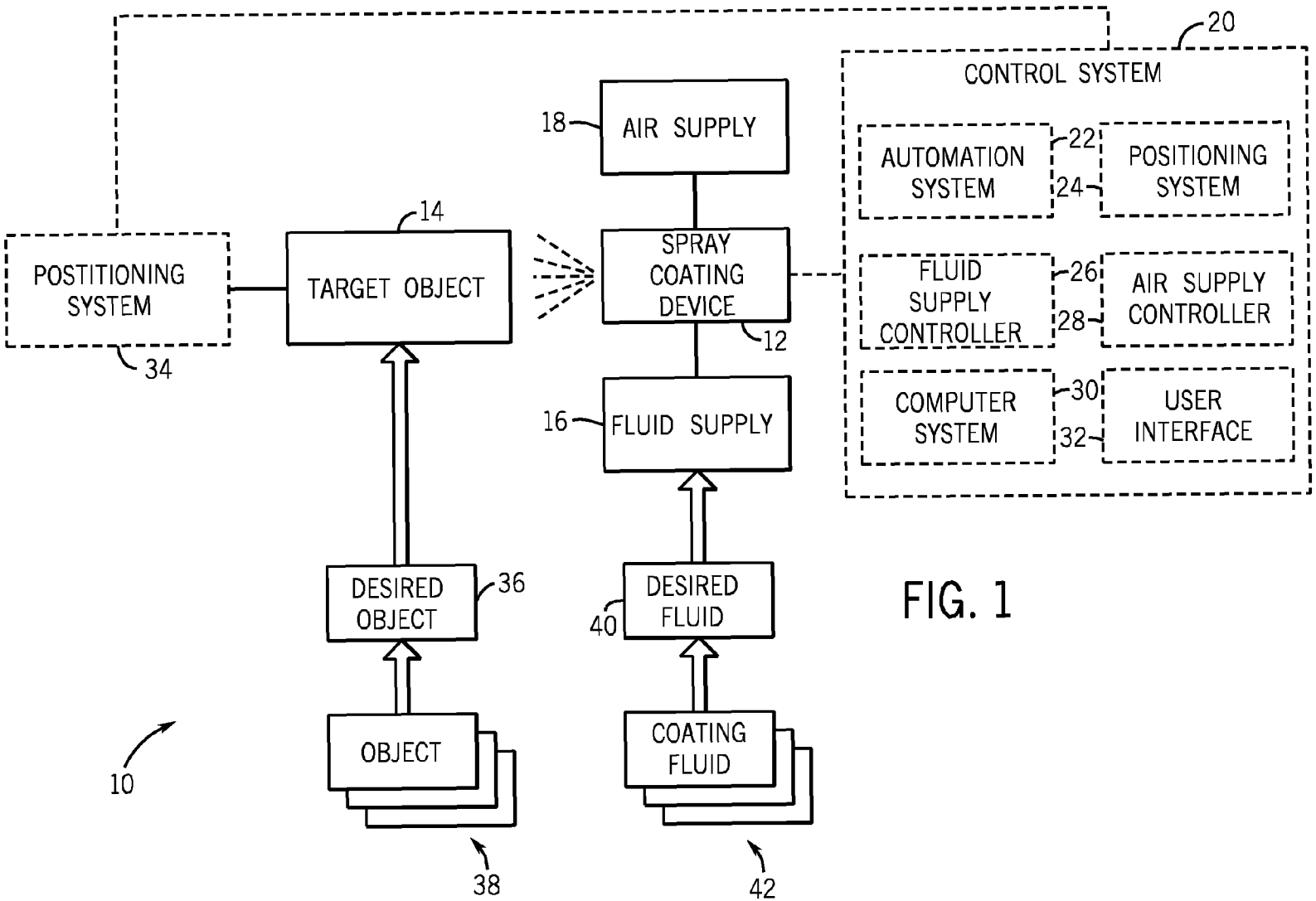
FIG. 1 is a diagram illustrating an embodiment of a spray coating system.

FIG. 1 is a flow chart illustrating an exemplary spray coating system 10, which comprises a spray coating device 12 for applying a desired coating to a target object 14. As discussed in detail below, various embodiments of the spray coating device 12 include a valve cartridge, which includes an assembly of several components to simplify the installation, removal, maintenance, repair, and cleaning of these components. In particular, at least some of these components of the valve cartridge are likely to wear out with use of the spray coating device 12, and are likely to undergo replacement, repair, or cleaning on more regular intervals. Thus, the valve cartridge decreases downtime by allowing a quick removal of a worn or dirty valve cartridge, and quick replacement of a new or clean valve cartridge. As mentioned above, this is particularly useful in assembly lines, for example, where downtime is costly. In certain embodiments discussed below, the components of the valve cartridge may include a valve, a valve seat, a seal, an overhead actuator, or a combination thereof. However, these are merely examples and are not intended to be limiting on the valve cartridge.

For simplicity, the spray coating device 12 will be described as an airless gun in the following description, although various embodiments of the spray coating device 12 may or may not have a gun-shaped body and/or an airless design. In certain embodiments, the airless gun 12 has a detachable/removable fluid head, which further includes an overhead fluid valve assembly with an integral trigger. The airless gun 12 also may have a body made from one solid piece of material, such as a light aluminum or a light plastic material, featuring a cavity for simple removal of components, such as a valve cartridge. The airless gun 12 may further include components, such as a rotary atomizer, an electrostatic atomizer, or any other suitable spray formation mechanism.

The airless gun 12 may be coupled to a variety of supply and control systems, such as a fluid supply 16 and a control system 20. The control system 20 ensures that the airless gun 12 provides an acceptable quality spray coating on the target object 14. For example, the control system 20 may include an automation system 22, a positioning system 24, a fluid supply controller 26, a computer system 30, and a user interface 32. The control system 20 also may be coupled to a positioning system 34, which facilitates movement of the target object 14 relative to the airless gun 12. Accordingly, the spray coating system 10 may provide a computer-controlled mixture of coating fluid and spray pattern. Moreover, the positioning system 34 may include a robotic arm controlled by the control system 20, such that the airless gun 12 covers the entire surface of the target object 14 in a uniform and efficient manner.

The spray coating system 10 of FIG. 1 is applicable to a wide variety of applications, fluids, target objects, and types/configurations of the airless gun 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. For example, the object 36 may include a vehicle, such as an automobile, an airplane, a marine vehicle, and so forth. The object 36 also may include household appliance (e.g., washing and drying machines), sinks, and toilets.

Figure 2:
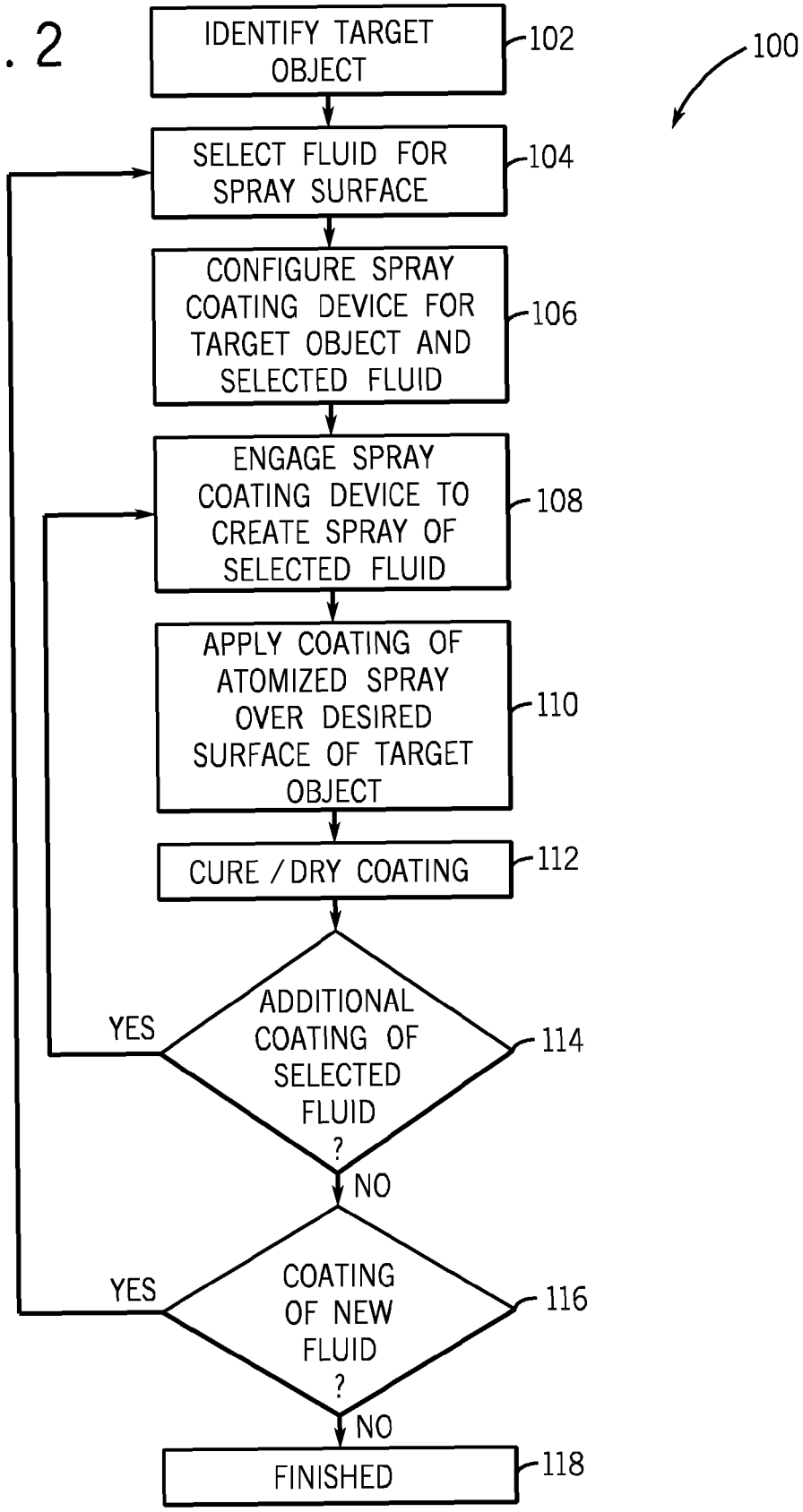
FIG. 2 is a flow chart illustrating an embodiment of a spray coating process.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the airless gun 12 for the identified target object 14 and selected fluid 40 (block 106). In certain embodiments, block 106 may include installing, replacing, or cleaning a valve cartridge in the spray coating device 12, as discussed in further detail below. As the user engages the airless gun 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
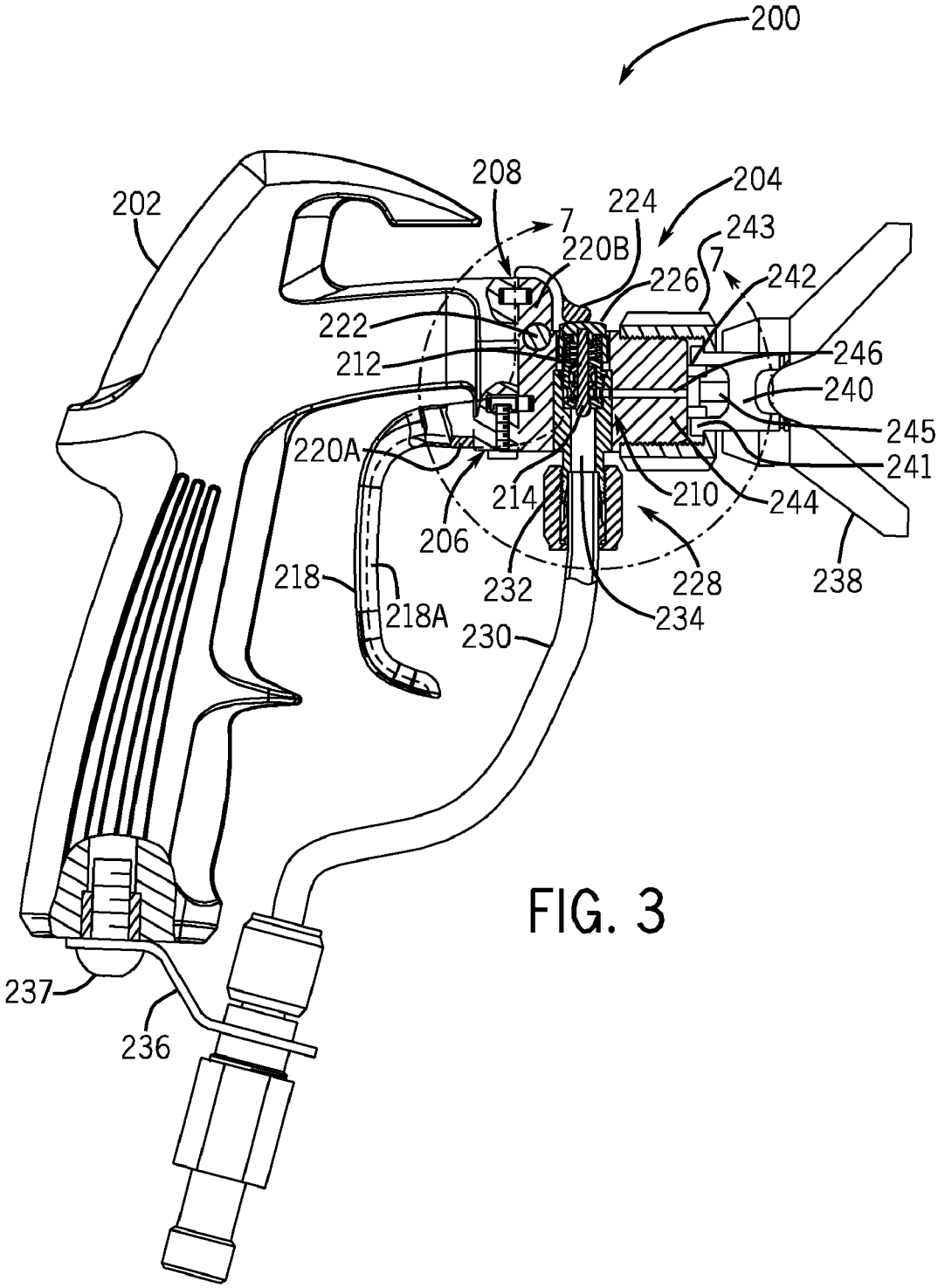
FIG. 3 is a cross-sectional side view of an embodiment of a spray coating device, such as an airless spray coating device used in the spray coating system and process as shown in FIGS. 1 and 2.

FIG. 3 is a cross-sectional side view of an embodiment of the airless gun 12 as discussed above with reference to FIGS. 1-2, and numbered here as airless spray coating device or airless gun 200. In the embodiment, airless gun 200 is formed of two main elements, namely cast handle 202 and removable fluid head 204, which are coupled together by quick connect/disconnect features such as locking mechanisms 206 and 208. Cast handle 202 may be formed of a light material, such as a light plastic, a light rubber material, a light metal such as aluminum, a ceramic, or a combination thereof, thereby providing a user with an ergonomic comfortable grip during operation of airless gun 200. Cast handle 202 may be formed by employing a casting or a molding process, whereby molten plastic and/or rubber are poured into a mold conforming cast handle 202 to a desired shape. Thus, the handle 202 has contours that ergonomically fit with a user's hand, while also being a simple one-piece structure that removably couples directly to fluid head 204. In addition, the illustrated embodiment of handle 202 does not include any fluid passages, fluid valves, or other functional features that affect the flow of fluid through fluid head 204. In other words, handle 202 may be described as a dummy handle without any functions other than enabling a user to grip the airless gun 200. However, other embodiments of handle 202 may include various functions, including but not limited to fluid passages, fluid valves, trigger, or a combination thereof.

Removable fluid head 204, as will be explained further below, may be detached from cast handle 202 so that a user may interchange removable fluid heads, for example, in situations when it desirable to clean or maintain the replaced fluid head. Alternatively, the detachable feature of fluid head 204 may enable a user to quickly interchange from one spray fluid to another by interchanging fluid heads. In so doing, the replaced fluid head may undergo a thorough cleaning between uses and, thus, be prepared for use in subsequent operations. Still in other situations, the detachable feature of removable head 204 enables a user to quickly replace the fluid head with a similar removable fluid head 204, should the replaced fluid head need maintenance, become damaged or malfunction during operation. Further still, the removable fluid head 204 may be replaced with different types and configurations of fluid heads, such as a rotary spray head, an air-assist spray head, an electrostatic spray head, or a combination thereof.

As mentioned above, cast handle 202 and removable fluid head 204 may be coupled with or decoupled from one another via locking mechanism 206 and 208. Locking mechanisms 206 and 208 may include, for example, cam locks, locking screws and/or locking pins with matching slots, latches, receptacles, and so forth. Locking mechanisms 206 and 208 are adapted to ease the assembly and/or disassembly of cast handle 202 from and/or with removable fluid head 204, respectively. As will be explained further below, airless gun 200 may be conveniently disassembled/or assembled in a manner enabling a user to conveniently interchange and/or replace the removable fluid head, such as removable fluid head 204, of the airless gun 200 during and/or between spray coating operations.

Airless gun 200 further includes a valve cartridge 210, which includes a variety of pre-assembled components for ease of assembly, replacement, maintenance, and so forth. In the illustrated embodiment, the valve cartridge 210 is installed in the removable fluid head 204. More specifically, the valve cartridge 210 may be placed in and removed from a cavity of the removable fluid head 204. The removability of valve cartridge 210 enables the valve cartridge 210 and/or the fluid head 204 to be removed for cleaning and/or maintenance as discussed above. Valve cartridge 210 includes several components that are particularly susceptible to wear by the coating fluid and/or general operation of the airless gun 200. Thus, the pre-assembled nature of the valve cartridge 210 simplifies the installation and removal process, thereby substantially reducing downtime associated with maintenance and repairs. In the illustrated embodiment, valve cartridge 210 includes a valve mechanism, e.g., valve stem 212 coupled to a ball-shaped member 214. Ball member 214 is adapted to close and/or open an aperture through which the coating fluid passes, as airless gun 200 is operated. The components of valve cartridge 210 are discussed and shown in further detail in FIG. 7.

Valve cartridge 210 may be actuated overhead by trigger 218, which may be coupled to (or one-piece with) a rotatable lever or trigger body 220. In the illustrated embodiment, trigger 218 and trigger body 220 are one-piece, such that a single structure receives a finger pull from a user in a first direction (e.g., horizontal) and translates this finger pull into a second direction (e.g., vertical or generally crosswise to the first direction) that engages and disengages valve cartridge 210. In other embodiments, trigger 218 and trigger body 220 may form two or more distinct structures coupleable/decoupleable with each other by latching and/or locking mechanisms. Trigger body 220 is adapted to pivot about pivot joint 222 such that moveable press lip 224 presses on valve button 226 to open valve cartridge 210. In other words, the trigger body 220 has first and second portions 220A and 220B disposed about opposite sides of the pivot joint 222, wherein first portion 220A is disposed adjacent a finger grip 218A of trigger 218 and second portion 220B includes press lip 224 disposed adjacent valve cartridge 210. While in the illustrated embodiment press lip 224 may be integrally coupled to trigger body 220 such that those structures form a single structure, other embodiments may include trigger body 220 and press lip 224 as two or more distinct structures coupled together by locking and/or latching mechanisms.

As further illustrated, press lip 224 is disposed directly above valve button 226, which is positioned at the upper portion of valve cartridge 210. As mentioned above, press lip 224 is adapted to press valve button 226 from overhead and, thereby, actuate valve cartridge 210 in an overhead manner. In so doing, valve stem 212 and ball-shaped member 214 move downward, enabling fluid to enter the aperture and flow through airless gun 200. As mentioned above, the structure of valve cartridge 210 may be referred to as an overhead valve assembly due to its placement and actuation generally over or above the fluid conduits within the spray device 200. As will be discussed further below, valve cartridge 210, trigger 218, trigger body 220, pivot 222 and press lip 224 form a mechanism that significantly reduces triggering effort to operate airless gun 200. That is, as a user pulls trigger 218, the transverse motion of trigger 218 applies a torque to trigger body 220 via pivot 222. Accordingly, by pivoting trigger body 220 about pivot joint 222, the transverse motion of the trigger 218 can be efficiently converted to vertical linear motion of valve stem 212. Thus, a user's pull on the trigger 218 can produce a significant amount of vertical force on the valve cartridge 210, thereby making the trigger pull very easy and less burdensome during long periods of operating the airless gun 200. For example, the trigger pull may be less than 3.2 pounds of force with the unique overhead arrangement of the components, including valve cartridge 210.

Airless gun 200 may be coupled to a pressurized spray fluid source via a fluid delivery assembly 228. Fluid delivery assembly 228 may include a fluid inlet tube 230 and a fluid inlet adapter 232. Fluid inlet tube 230 is coupled to fluid inlet adapter 232, which in turn is coupled to a vertical fluid passage 234 disposed at the bottom of removable fluid head 204. Fluid passage 234 is coupled to fluid valve cartridge 210 enabling fluid flow of a pressurized fluid source to removable fluid head 204.

As further illustrated, fluid inlet tube 230 may be coupled to cast handle 202 via attachment 236. In the illustrated embodiment, one end of attachment 236 may be securely attached to cast handle 202 via a screw or bolt 237 fitted in the bottom portion of cast handle 202. The other end of attachment 236 may include a hole through which fluid inlet tube 230 may securely fit. Further, fluid inlet tube 230 may be disposed in relation to cast handle 230 such that the space formed between trigger 218 and fluid inlet tube 230 enables a user to conveniently grip trigger 218. In addition, by partially encompassing trigger 218, fluid inlet tube 230 may define or function as a finger guard as the user holds and/or actuates trigger 218.

Airless gun 200 further includes a fluid spray tip assembly or bell cup 238. The illustrated spray tip assembly 238 includes a fluid delivery tip assembly 240, which includes a flanged portion 241 removably captured in a receptacle 242 between a threaded retention cap 243 and a threaded front portion or cylinder 244 of fluid head 204. For example, cap 243 may capture flanged portion 241 of assembly 240, and then pull it tightly against cylinder 244 as cap 243 threads onto cylinder 244. As illustrated, fluid delivery tip assembly 240 has a cylindrical shape with flanged portion 241 and an internal passage 245, which can be fluidly coupled with fluid passage 246 in cylinder 244. These parts 238, 240, and 244 may be coupled together with a variety of fasteners, such as threaded retention cap 243. For example, assembly 240 may couple directly with assembly 238 via threads, a friction fit, a snap-fit, a slot and key and associated fastener, an annular groove and c-shaped spring fastener, or a combination thereof. A plurality of different types of spray coating devices may be configured to receive and use fluid delivery tip assembly 240. Spray tip assembly 238 may include other components, such as a spray formation assembly configured to define the shape of a spray forming downstream of the airless gun 200.

In certain embodiments, the spray tip assembly 238 may be rotated or twisted to unplug internal orifices in the spray tip assembly 238, the fluid delivery tip assembly 240, or a combination thereof. This twisting unplug motion, in some embodiments, may be applied without unfastening the spray tip assembly 238 from the fluid delivery tip assembly 240. In other words, the spray tip assembly 238 may be free to rotate relative to the fluid delivery tip assembly 240. In addition, the fluid delivery tip assembly 240 may be made of ceramic, tungsten carbide, or a combination thereof. The ceramic and/or tungsten carbide substantially improves the wear resistance of the fluid delivery tip assembly 240. Furthermore, for simplicity in some embodiments, the airless gun 200 may be assembled with a limited number of parts, thereby reducing costs and rendering the gun 200 easier to assemble/disassemble, clean, repair, and so forth. For example, in certain embodiments, the airless gun 200 may be described as consisting of, or consisting essentially of, the dummy handle 202, the removable fluid head 204, the valve cartridge 210, the trigger 218, the fluid delivery tip assembly 240, and the spray tip assembly 238. However, some embodiments may further include a quick connect/disconnect feature between the handle 202 and removable fluid head 204. For example, the quick connect/disconnect feature may include a cam mechanism, a hook and fastener, or another easily attachable and releasable connector such as described above.

As further illustrated, cylinder 244 is disposed directly between fluid tip delivery assembly 240 and valve cartridge 210. Disposed within cylinder 244 is horizontal fluid passage 246 extending from fluid passage 245 in fluid delivery tip assembly 238 to valve cartridge 210. Accordingly, horizontal fluid passage 246 is adapted to deliver spray fluid from valve cartridge 210 to fluid tip delivery assembly 238 when the valve cartridge is in an open position.

Figures 4, 5, 6:
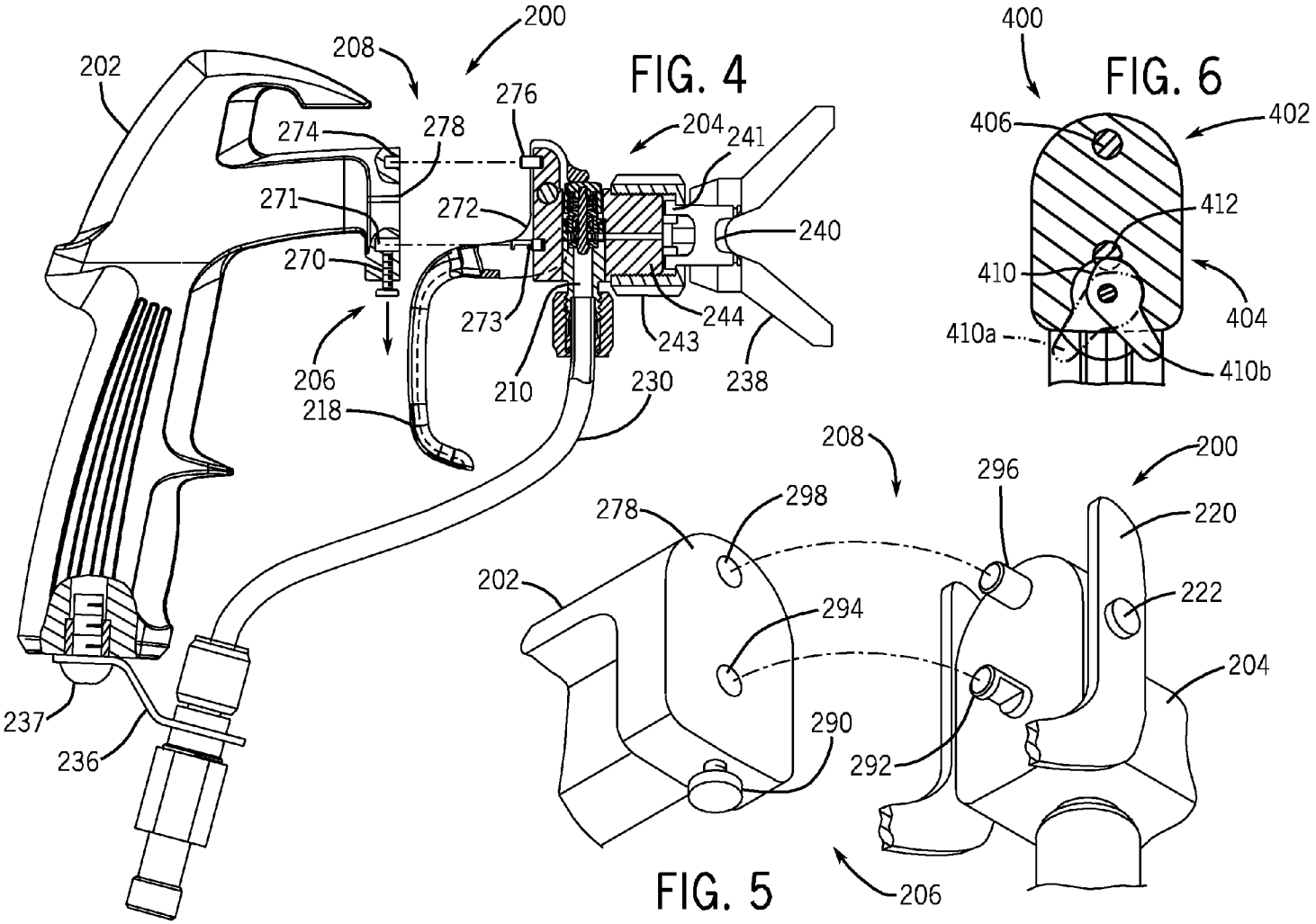
FIG. 4 is an exploded side view of an embodiment of the spray coating device as shown in FIG. 3, wherein portions of the spray coating device are shown in cross-sections.
FIG. 5 is an exploded perspective view of an embodiment of a locking mechanism of the spray coating device as shown in FIG. 3.
FIG. 6 is a cross-sectional front view of an embodiment of another locking mechanism of the spray coating device as shown in FIG. 3.

FIG. 4 is an exploded perspective view of an embodiment of an airless spray coating device, such as airless gun 200 shown in FIG. 3. Accordingly, FIG. 4 illustrates cast handle 202 and fluid head 204 in close proximity, but detached from one another. Detaching fluid head 204 from cast handle 202 may be conveniently performed to accommodate situations where it may be desirable to interchange spray coating fluids requiring different fluid heads, or in situations where the fluid head requires cleaning and/or maintenance, or otherwise in situations where the fluid head becomes inoperable.

The illustrated locking mechanisms 206 and 208 include additional components adapted to lock or disengage fluid head 204 from cast handle 202. In the illustrated embodiment, locking mechanism 206 may include locking member 270, such as a screw and/or a cam lock, disposed within the bottom portion of the cast handle's head 202. Locking member 270 is adapted to move inwardly and outwardly of receptacle 271, such that member 270 can engage receiving member 272 disposed at the bottom portion of removable fluid head 204. Specifically, the illustrated receiving member 272 may have a hook-shaped structure, which includes a hooked end or recess 273 that can be secured by locking member 270 in receptacle 271. Similarly, locking mechanism 208 includes locking member 274 disposed within the upper portion of cast handle 202. Locking member 274 is adapted to engage with receiving member 276 disposed at the upper portion of removable fluid head 204. Accordingly, locking mechanisms 206 and 208 are adapted to integrally fit cast handle 202 and fluid head 204 such that those components may be coupled together to define a single unit. In the illustrated embodiment, locking mechanism 206 is configured to lock cast handle 202 to removable fluid head 204, while locking mechanism 208 may be configured to provide additional support and/or alignment when the aforementioned components of airless gun 200 are assembled.

As further illustrated, during engagement/disengagement of cast handle 202 and fluid head 204, cast handle 202 may be adapted to slide through a central space in trigger 218 so that trigger body 220 and surface 278 of cast handle 202 abut against each other. In so doing, locking mechanisms 206 and 208 and components thereof are aligned, thereby enabling the smooth attachment or detaching of cast handle 202 and fluid head 204.

Further, in some embodiments, trigger 218 may be removable and replaceable so that airless gun 200 may accommodate various trigger sizes. In some embodiments, triggers, such as trigger 218, may be sized so as to accommodate a grip of two or four fingers. Removing trigger 218 from fluid head 204 may be achieved by, for example, first removing pivot joint 222, to which trigger body 220 is coupled, which thereafter enables removing trigger body 220 and trigger 218 as a single unit from removable fluid head 204. Accordingly, in such an embodiment, replacing trigger 218 may constitute replacing trigger body 220 as well. Still in other embodiments, trigger 218 may simply latch off trigger body 220 (using a latching mechanism), thus, enabling fitting removable fluid head 210 with a trigger of a different size.

As mentioned above, the detachment of fluid head 204 from cast handle 202 enables a user to switch fluid heads and/or valve cartridges 210 between operations of airless gun 200. This may be particularly desirable whenever a spray coating job requires applying multiple spray coatings across a surface where each of the spray coatings, such as paint of a particular color, is applied with a different fluid head. Alternatively, the illustrated detachment feature of airless gun 200 may help a user to clean and maintain the airless gun 200 and, particularly, facilitate removal of coating fluid residues deposited in the removable fluid head and valve cartridge 210 during and/or between operations of the airless gun 200. For example, after use, the fluid head 204 and/or valve cartridge 210 may be removed from cast handle 202 and submerged within a cleaning fluid so as to remove the fluid residues, paint stains and so forth. Thereafter, fluid head 204 and/or valve cartridge 210 may be reattached to cast handle 202 and airless gun 200 may be used again with a different spray fluid. Accordingly, unlike spray coating devices which otherwise may require full disassembly for thorough cleaning, removable fluid head 204 and valve cartridge 210 may enable efficiently spraying a surface with a single spray coating device, such as airless gun 200, subsequently applying spray coating fluids.

FIG. 5 is an exploded perspective view of an embodiment of a locking mechanism of a spray gun, for example, airless gun 200 shown in FIGS. 3 and 4. As illustrated, cast handle 202 and fluid head 204 may detach from one another as facilitated by locking mechanisms 206 and 208. In the illustrated embodiment, locking mechanism 206 includes a screw 290 and U-shaped receptacle 292 which fits into opening 294. Similarly, locking mechanism 208 includes pin 296 fitting within opening 298. Accordingly, upon, for example, the attachment of cast handle 202 to fluid head 204, receptacle 292 and pin 296 are fitted in openings 294 and 298, respectively. Thereafter, screw 290 is rotated to mate with receptacle 292, such that screw 290 is locked into place with receptacle 292 and rotated until a sufficient force is applied to receptacle 292, so as to rigidly maintain cast handle 202 and fluid head 204 in place.

FIG. 6 is a front cross-sectional view of an alternative embodiment of a locking mechanism for a spray gun, for example, airless gun 200 shown in FIGS. 3 and 4. More specifically, FIG. 6 illustrates an alternate locking mechanism used to attach/detach a cast handle and a fluid head, such as cast handle 202 and fluid head 204 of airless gun 200. The illustrated embodiment depicts a spray coating device 400 having locking mechanisms 402 and 404. It should be borne in mind that in the illustrated embodiment the cast handle and the removable fluid head, such as cast handle 202 and removable fluid head 204, are coupled together or are otherwise adjacent to one another. Accordingly, locking mechanism 402 may be similar to locking mechanisms 208 in that it may be formed of a pin 406 fitted within a slot. The fitting of pin 406 into a slot is adapted to provide sufficient support in keeping the upper portions of the cast handle and the fluid head aligned and in close proximity with one another.

Further, locking mechanism 404 is formed of a cam arm 410 rotatable about receptacle 412 (e.g., U-shaped receptacle or hook structure) which may be similar to receptacle 292 shown in FIG. 5. In the illustrated embodiment, cam arm 410 may be placed in one of two positions, e.g., unlocked position 410*a* or locked position 410*b*. By being placed in either one of the aforementioned positions 410*a* or 410*b*, cam arm 410 disengages or engages receptacle 412. For example, when attaching the cast handle with the fluid head, cam arm 412 may be rotated into the locking position to apply a sufficient force to receptacle 412 to thereby maintain the fluid head and the cast handle together as a single unit. Similarly, when detaching the cast handle from the fluid head, cam arm 410 may be rotated into the corresponding unlocking position, e.g., position 410*a*, to thereby ease the force applied to receptacle 412 so that the fluid head and the cast handle may be taken apart.

Figure 7:
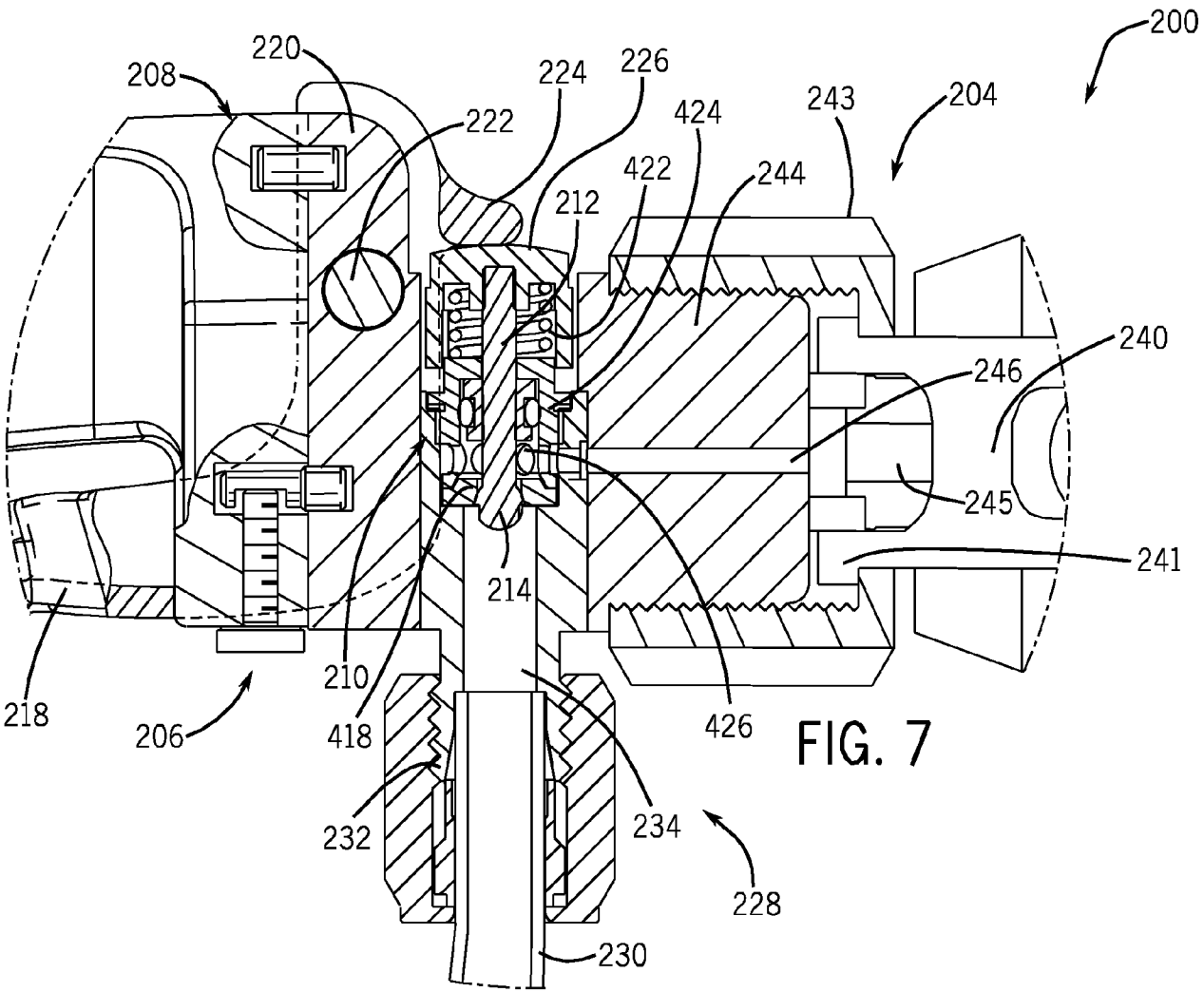
FIG. 7 is a cross-sectional side view of an embodiment of a valve cartridge of the spray coating device as shown in FIG. 3, wherein the valve cartridge is shown in a closed position.
Figure 8:
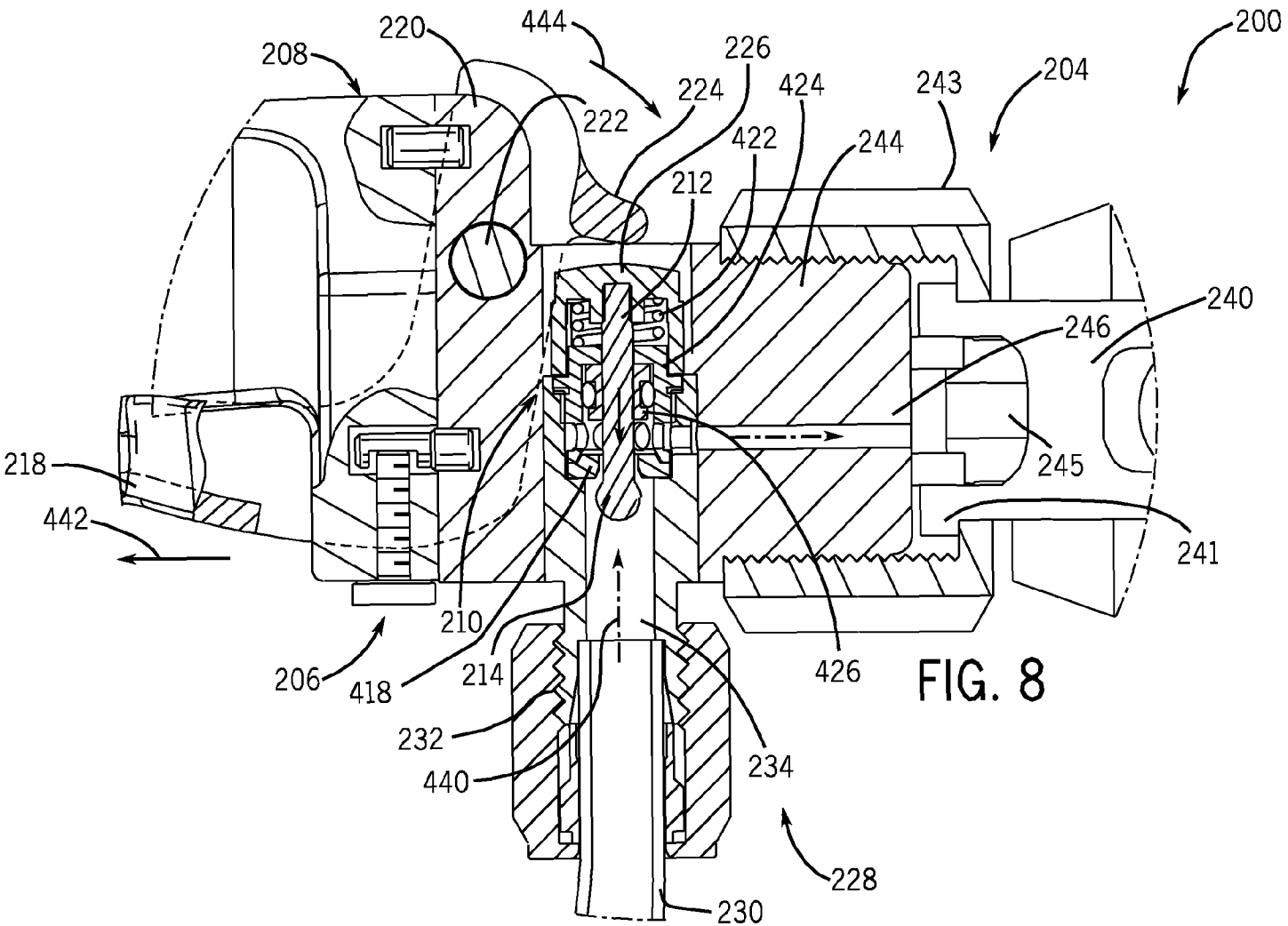
FIG. 8 is a cross-sectional side view of an embodiment of the spray coating device as shown in FIG. 7, wherein the valve cartridge is shown in an open position.

FIGS. 7 and 8 are partial cross-sectional side views of the portion of the airless gun 200 indicated by line 7-7 in FIG. 3, in accordance with an embodiment of the present technique. Accordingly, FIGS. 7 and 8 depict a closed position and an open position of overhead fluid valve cartridge 210 of airless gun 200 discussed above in relation to FIG. 3. As illustrated, for example in FIG. 7, valve cartridge 210 has valve stem 212 coupled to ball-shaped member 214 and to valve button 226. In certain embodiments, valve stem 212 and ball-shaped member 214 may be formed of two separate pieces fused with one another, or alternatively, the valve stem 212 and ball-shaped member 214 may be formed as a single piece. As further illustrated, ball-shaped member 214 is lodged within an aperture of valve seat 418, which forms the valve opening of the valve cartridge 210. Thus, when the valve cartridge 210 is in the closed position as shown in FIG. 7, ball-shaped member 214 abuts valve seat 418 such that a portion of ball shaped member 214 completely seals the aperture. That is, valve seat 418 may be completely disposed about ball-shaped member 214, such that a portion of ball shaped member 214 substantially complements the aperture of valve seat 418, while a remaining portion of ball-shaped member 214 remains disposed within vertical fluid passage 234. When fluid valve cartridge 210 is in the closed position, ball-shaped member 214 is adapted to prevent fluid from entering removable fluid head 204.

Valve cartridge 210 further includes a biasing member, such as spring 422, wound about valve stem 212, such that spring 422 is disposed between valve button 226 and valve body 424. Spring 422 is adapted to balance the force applied to stem valve 212 either from the pressing force applied by press lip 224 or from the force applied by the fluid entering vertical passage 234 into removable fluid head 204, as the press lip 224 is pressed to open and/or close valve cartridge 210. Accordingly, spring 422 and trigger 218 enable the user to conveniently control the opening and closing fluid flow to the fluid head during operation of airless gun 200.

As further illustrated, horizontal fluid passage 246 is disposed within the center of cylinder 244 such that horizontal fluid passage is joined with vertical fluid passage 234 above valve seat 418. Accordingly, horizontal fluid passages 246 and vertical fluid passage 234 meet inside valve cartridge 210, which enables fluid to pass to fluid tip delivery assembly 240.

FIG. 8 illustrates fluid valve cartridge 210 in an open position, whereby spray coating fluid, indicated by arrow 440, moves up vertical fluid passage 234. Accordingly, fluid valve cartridge 210 may be opened by pulling trigger 218 in a direction shown by arrow 442. Pulling trigger 218, as shown by arrow 442, causes trigger body 220 to pivot about pivot joint 222, as indicated by arrow 444. Consequently, press lip 224 presses on button valve 226 and, in so doing, valve stem 212 moves downward countering pressure applied upward by the fluid against ball-shaped member 214. Valve stem 212 may move a sufficient distance so that the aperture of valve seat 418 is sufficiently exposed to let fluid enter the cavity above seat 418 and ball shaped member 214. In the open configuration of the valve cartridge 210, the fluid circumvents ball-shaped member 214 as the fluid enters the aperture of seat 418. Thereafter, the fluid is channeled through horizontal fluid tube 246 until the fluid reaches fluid tip delivery assembly 240, where the fluid exits airless gun 200. As mentioned above, valve cartridge 210, trigger 218, trigger body 220, pivot 222 and press lip 224 cooperate with one another as a mechanism that significantly reduces the triggering effort needed to open and/or close valve cartridge 210. In some embodiments, the ratio of the amount of force applied to the fluid valve cartridge 210 to the amount of force applied to trigger 220 may be as large as 24/1.

With reference to FIGS. 7 and 8, valve cartridge 210 may be described as a pre-assembled unit or module, which can be installed and removed from fluid head 204 of airless gun 200 as a whole rather than in numerous discrete parts in a sequential manner. In other words, in the illustrated embodiment, valve cartridge 210 includes valve stem 212, ball shaped member 214, valve body 424, valve seat 418, spring 422, and button 226 all assembled together as a unit, e.g., a self-contained or stand-alone unit. Specifically, the illustrated valve cartridge 210 is coupled together by placing spring 422 between button 226 and body 424, inserting valve stem 212 through valve seat 418 and body 424, and coupling (e.g., threading) valve stem 212 to button 226. Once these components are coupled together, spring 422 biases stem 212 and ball shaped member 214 inwardly toward seat 418, such that valve is normally closed. The illustrated valve cartridge 210 also may include one or more seals (e.g., o-rings), washers, and wear items as part of the pre-assembled unit. Furthermore, in the illustrated embodiment, valve cartridge 210 is installed between press lip 224 and tube 230. For example, valve cartridge 210 may be threaded into fluid head 204, press-fit into fluid head 204, or coupled in another manner.

FIG. 9 is a cross-sectional side view of an embodiment of the airless gun 12 as discussed above with reference to FIGS. 1-2, and numbered here as airless spray coating device or airless gun 250. The embodiment includes spray gun body 500 which may be made of light weight aluminum, light weight plastic/rubber, or any suitable light weight material. Body 500 includes a handle and may be formed of a light material, such as a light plastic, a light rubber material, a light metal such as aluminum, a ceramic, or a combination thereof, thereby providing a user with an ergonomic comfortable grip during operation of airless gun 250. Body 500 may be formed by employing a casting or a molding process, whereby molten plastic and/or rubber are poured into a mold conforming body 500 to a desired shape. Thus, the handle has contours that ergonomically fit with a user's hand, while also being a simple one-piece structure.

Airless spray gun 250 includes fluid delivery assembly 502, which routes coating fluid to the airless spray gun 250. Airless gun 250 may be coupled to a pressurized spray fluid source via a fluid delivery assembly 502. Fluid delivery assembly 502 may include a fluid inlet tube and an adapter. Fluid delivery assembly 502 is connected to fluid conduit 504 which is located inside the handle of spray gun body 500. Fluid conduit 504 may include a filter to remove particles and other impurities from the coating fluid as it travels through the spray gun handle. In the embodiment, fluid conduit 504 routes the coating fluid to upper fluid conduit 506. Upper fluid conduit 506, in turn, routes the coating fluid to the cartridge fluid conduit 508 which connects the upper fluid conduit 506 to valve cartridge 210. In the illustrated embodiment, conduits 504, 506, and 508 are all integrally formed with the body 500. For example, conduits 504, 506, and 508 may be formed by drilling out passages in body 500 after molding body 500 as discussed above. As further illustrated, the cartridge fluid conduit 508 allows coating fluid to flow in a generally downward direction from the upper fluid conduit 506 into a fluid chamber 512 of cartridge sleeve 510.

In the illustrated embodiment, cartridge sleeve 510 is press-fit into spray gun body 500. However, in alternative embodiments, cartridge sleeve 510 may be threaded, latched, welded, adhered, or otherwise coupled to body 500. When the valve cartridge 210 is open, fluid chamber 512 routes the coating fluid through valve cartridge 210 to the nozzle of the airless spray gun 250. Cartridge sleeve 510 may be composed of any light weight durable material such as an aluminum alloy or a plastic. In the illustrated embodiment, valve cartridge 210 slides into and threadably attaches to the upper portion of valve cartridge sleeve 510. However, in alternative embodiments, valve cartridge 210 may be press-fit, clamped, bolted, or otherwise mounted to the body 500 and/or sleeve 510. The coating fluid flows from sleeve 510 through valve cartridge 210 to a horizontal fluid exit passage 514 which is located inside threaded barrel 516. Threaded barrel 516 is a part of the spray gun body 500. That is, threaded barrel 516 and spray gun body 500 are formed as one piece from the same material. Valve cartridge 210 features a valve which opens and closes, allowing coating fluid to pass through horizontal fluid exit passage 514 to a spray tip assembly (e.g., 238 of FIG. 3), which may be threadably attached to barrel 516. As previously discussed with reference to FIG. 3, the spray tip assembly 238 may include a fluid delivery tip assembly 240, which includes a flanged portion 241 removably captured in a receptacle 242 between a threaded retention cap 243 and a threaded front portion of barrel 516.

Valve cartridge 210 and its components may be opened and closed by the operator squeezing trigger 518, which is attached to press-lip 520 that contacts the upper portion of valve cartridge 210. Trigger 518 is attached to spray gun body 500 by pivot 522, thereby enabling the press-lip 520 to actuate opening and closing of the valve cartridge 210 in an overhead arrangement similar to FIG. 3-8. In addition, airless spray gun 250 features a trigger shield 524, which is attached to cartridge sleeve 510 and fluid delivery assembly 502. As previously discussed, cartridge sleeve 510 is a removable component, and may be press-fit into spray gun body 500. Further, valve cartridge 210 is also removable from the upper portion of a cavity within spray gun body 500 and barrel 516. Again, both of these fluid contacting components 210 and 510 may be removed for cleaning and/or maintenance of the airless spray gun 250, thereby minimizing downtime between projects. Moreover, as previously discussed, the arrangement of trigger 518, press-lip 520, and valve cartridge 210 enable the user to reduce the amount of force needed to actuate the overhead valve contained within valve cartridge 210.

Figure 10:
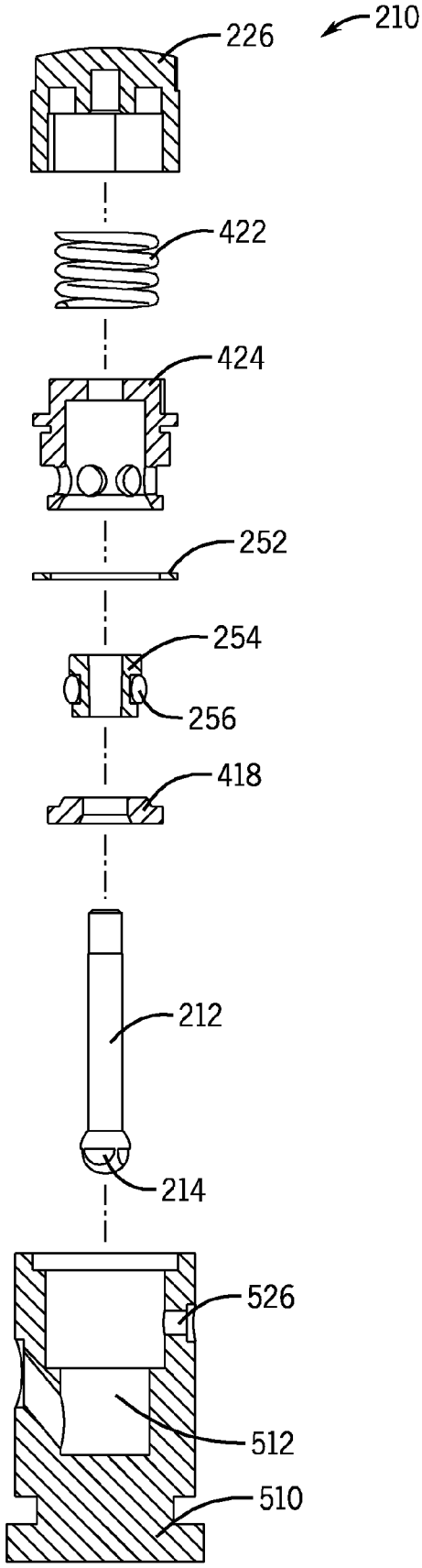
FIG. 10 is an exploded cross-sectional side view of an embodiment of a valve cartridge of the spray coating device as shown in FIG. 9.

FIG. 10 illustrates an exploded cross-sectional side view of an embodiment of valve cartridge 210 and its components. In the illustrated embodiment, valve cartridge 210 includes button 226, spring 422, body 424, guide 254, seal 256, seat 418, stem 212, and ball shaped member 214. These components of the valve cartridge 210 are pre-assembled and subsequently coupled to sleeve 510. As discussed further below, valve cartridge 210 is assembled by inserting stem 212 through seat 418, guide 254, seal 252, body 424, spring 422, and partially into button 226. At this point, stem 212 is coupled to an interior portion of button 226. In the illustrated embodiment, stem 212 threads into a threaded receptacle inside button 226, thereby capturing spring 422 between button 226 and body 424. Also, when assembled in this manner, spring 422 biases stem 212 and ball shaped member 214 upwardly or inwardly toward seat 418. Thus, the ball shaped member 214 is disposed in a normally closed position, which can be overcome by biasing the button 226 downwardly from an overhead position as discussed in detail above. Further details of valve cartridge 210 are discussed below.

The configuration of valve cartridge 210 in the present embodiment may also be referred to as an overhead valve assembly. Included in valve cartridge 210 is valve button 226, which surrounds at least a portion of spring 422. Spring 422 may be any type of suitable biasing member, such as a coil spring, opposing magnets, pneumatic pressure biased member (e.g., piston-cylinder), resilient material (e.g., rubber), or the like. Spring 422 rests on valve body 424, which features inlet and outlet chambers as well as an aperture for valve stem 212. Seal 252 forms a seal between cartridge sleeve 510 and valve body 424. In operation, seal 252 blocks the coating fluid from reaching spring 422 and button 226. Thus, spring 422 and button 226 remain isolated from the coating fluid. Valve guide 254 fits within valve body 424 and is secured and sealed within valve body 424 by guide seal 256. Valve guide 254 features a cylindrical passage, which valve stem 212 passes through as it moves upward or downward to open or close the overhead valve. Valve seat 418 fits beneath valve guide 254 and is generally composed of a rubber, plastic or other suitable material. The components of valve cartridge 210 may be formed from plastic, rubber, aluminum, stainless steel, or any other suitable durable material. Valve seat 418 also features an aperture for valve stem 212 to pass through. In addition, when valve cartridge 210 is in a closed position, valve stem 212 and ball-shaped member 214 rests against valve seat 418, thereby closing the overhead valve assembly. Valve stem 212 may be threadably attached to valve button 226 in order to actuate the opening or closing of the valve cartridge 210.

As previously discussed, valve cartridge 210 fits inside at least a portion of cartridge sleeve 510. For example, valve cartridge 210 may be threaded into sleeve 510. When the valve assembly is open, fluid may enter valve cartridge sleeve 510 through fluid chamber 512 and exit fluid passage 526. Valve cartridge 210 includes components in the fluid path, thereby resulting in the need for replacement or cleaning over the course of using the spray gun 250. Accordingly, the valve cartridge 210 enables quick removal and replacement of worn components, as the components are all pre-assembled as a self-contained unit. Further, cartridge sleeve 510 may also be removed and/or replaced for cleaning and servicing.

FIGS. 11 and 12 are partial cross-sectional side view of a portion of the airless spray gun 250 shown in FIG. 9, illustrating installation of valve cartridge 210 in accordance with certain embodiments. The figures show a cross-section of valve cartridge 210, cartridge sleeve 510 as well as a portion of spray gun body 500 and gun barrel 516. FIG. 11 shows valve cartridge 210 above body cavity 528, which is configured to receive cartridge sleeve 510 and cartridge 210. In FIG. 11, body cavity 528 is cylindrical. Further, certain components are removed for clarity, such as press-lip 520 and trigger 518. FIG. 12 shows the cartridge sleeve 510 and valve cartridge 210 inserted into body cavity 528. The diagram shows the valve cartridge 210 in a closed position. In other words, ball-shaped valve member 214 is pressed against valve seat 418, closing the valve and stopping fluid flow. As previously discussed, cartridge sleeve 510 may be press-fit into the bottom portion 530 of body cavity 528 against lip 532. In addition, valve cartridge 210 is inserted into body cavity 528 from the top portion 534 of spray gun 500. In the present embodiment, cartridge sleeve 510 and valve cartridge 210 are threaded together at interface 536 to secure both components inside body cavity 528. Further, the threaded configuration of valve cartridge 210 and cartridge sleeve 510 allows for easy removal of both components for cleaning and/or maintenance. As illustrated, when the valve assembly of valve cartridge is open, the coating fluid may enter upper fluid conduit 506, flow down cartridge fluid conduit 508 to sleeve fluid chamber 512, flow through an aperture in the valve seat 418 and then flow out cartridge exit conduit 526 through fluid exit passage 514 to a nozzle assembly (not shown).

As discussed above with reference to FIGS. 3-12, various embodiments of the spray coating device 12 of FIG. 1 may include a valve cartridge 210 to simplify installation, removal, maintenance, cleaning, and general use of the device 12. More specifically, valve cartridge 210 may include a variety of seals, valve components, and wear items pre-assembled together as a self-contained or stand-alone unit. As a result, these items as part of the pre-assembled valve cartridge 210 may be installed and removed simultaneously rather than sequentially as one discrete part after another. As appreciated, at least some of the components of the valve cartridge 210 are disposed within a fluid flow path, such that they are susceptible to wear over the course of use. In fact, some of the components may require routine cleaning, replacement, or repair. By assembling these parts together as the valve cartridge 210, the spray coating device 12 can be quickly repaired by removing the existing cartridge 210 and installing a replacement. This quick installation and removal procedure can drastically reduce downtime. Subsequently, the removed cartridge 210 may be discarded or salvaged for a future use.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An airless spray coating system, comprising:

a spray gun comprising:

a receptacle;

a sleeve inserted through a first opening into the receptacle; and a valve cartridge inserted through a second opening into the receptacle, wherein the first and second openings are opposite from one another, the valve cartridge comprises a biasing member, a valve seat, a seal, and a valve member having a ball-shaped member, the valve member extends through the seal with the ball-shaped member disposed adjacent a side of the seal facing the first opening, the valve member is biased in a first direction toward the valve seat via the biasing member, the valve member is movable in a second direction away from the valve seat, and the first and second directions are crosswise to a spray exit.

2. The system of claim 1, wherein the biasing member is not exposed to a fluid passing through the valve cartridge.

3. The system of claim 1, wherein the spray gun comprises an internal passage that delivers a coating fluid to the valve cartridge.

4. The system of claim 1, wherein the spray gun is airless.

5. The system of claim 1, comprising a trigger having a pivot joint coupled to the spray gun, the trigger has first and second portions disposed on opposite sides of the pivot joint, the first portion is coupled to a finger grip, and the second portion extends over a top portion of the valve cartridge to move the valve member.

6. The system of claim 1, wherein the sleeve at least partially surrounds the valve cartridge, the sleeve is press fit through the first opening into the receptacle, and the valve cartridge is captured by a press lip of a trigger over the second opening.

7. The system of claim 1, wherein the valve cartridge comprises a button configured to actuate movement of the valve member, wherein the button at least partially surrounds the biasing member.

8. The system of claim 1, wherein the spray gun comprises a fluid head coupled to a body via a quick disconnect fastener, the receptacle is disposed in the fluid head, and the spray gun comprises a trigger coupled to the fluid head.

9. The system of claim 8, wherein the quick disconnect fastener comprises a guide and a latch separate from one another.

10. A spray coating system, comprising:

a valve cartridge and a sleeve that is configured to receive the valve cartridge, the valve cartridge comprising:

a button;

a body;

a valve seat;

a seal;

a spring;

a valve member disposed completely through the seal and the spring, wherein the valve member is coupled to the button to capture the spring between the button and the body, the spring biases the valve member in a first direction from an open position toward a closed position against the valve seat, the valve member is movable in a second direction from the closed position toward the open position away from the valve seat, and the valve cartridge has a fluid exit oriented in a third direction transverse to the first and second directions.

11. The system of claim 10, wherein the valve cartridge is configured to mount in a first mounting direction into a valve receptacle in a spray coating device, the sleeve is configured to mount in a second mounting direction into the valve receptacle, and the first and second mounting directions are opposite from one another.

12. The system of claim 11, comprising the spray coating device having the valve receptacle, wherein the sleeve is press fit through a first opening into the valve receptacle, the valve cartridge is inserted through a second opening into the valve receptacle, and the first and second openings are opposite from one another.

13. The system of claim 10, wherein the spray coating system is airless.

14. The system of claim 10, wherein the valve member is actuated in a direction generally crosswise to a spray exit conduit.

15. The system of claim 10, wherein the spring is not exposed to a fluid passing through the valve cartridge.

16. The system of claim 10, wherein a valve guide and the spring are located above a flow of fluid through the valve cartridge.

17. The system of claim 10, wherein the button at least partially surrounds the spring.

18. A spray coating system, comprising:

a valve cartridge comprising:

a valve body comprising a valve seat;

a biasing member;

a seal;

a valve member disposed through the seal and the valve body; and a button at least partially surrounding the biasing member and the valve member, wherein at least a portion of both the biasing member and the valve member are located within the button, and wherein the valve seat, the biasing member, the seal, and the button are assembled with one another as a unit that stands alone, installs into, and is removable from a spray coating device.

19. The system of claim 18, wherein the valve member is biased in a first direction toward the valve seat via the biasing member, and the valve member is moved in a second direction away from the valve seat via movement of the button.

20. The system of claim 18, wherein the biasing member is not exposed to a fluid passing through the valve cartridge.

21. A spray coating system, comprising:

an airless spray device comprising:

a body;

a valve cartridge receptacle that extends completely through the body of the airless spray device, wherein the valve cartridge receptacle consists essentially of first and second receptacle portions separated by a lip, and an axis of the valve cartridge receptacle is crosswise to a spray exit and parallel to a fluid inlet of the airless spray device; and a cartridge sleeve and a valve cartridge disposed in the valve cartridge receptacle.

22. The system of claim 21, wherein the cartridge sleeve extends through a first opening of the valve cartridge receptacle into the first receptacle portion, the valve cartridge extends through a second opening of the valve cartridge receptacle into the second receptacle portion, and the first and second openings are opposite from one another.

23. The system of claim 21, comprising a trigger having a pivot joint coupled to the body, the trigger has first and second portions disposed on opposite sides of the pivot joint, the first portion is coupled to a finger grip, and the second portion extends over a top portion of the valve cartridge receptacle to actuate a valve member.

24. The system of claim 21, comprising a valve cartridge comprising a valve seat, a spring, a seal, and a valve member disposed through the seal and the spring, wherein the valve member is biased toward the valve seat via the spring, and the spring is isolated from a fluid path through the valve cartridge.

25. A spray coating system, comprising: a sleeve configured to press fit in a first direction into a receptacle of a spray coating device; and a valve cartridge configured to fit in a second direction into the receptacle within the sleeve, wherein the second direction is opposite from the first direction, and the valve cartridge comprises a valve seat, a biasing member, a seal, and a valve member disposed completely through the seal and the biasing member, the valve member is biased toward the valve seat via the biasing member, wherein the biasing member is isolated from a fluid path through the valve cartridge.

26. The system of claim 25, wherein the sleeve is configured to threadibly receive the valve cartridge.

27. The system of claim 18, comprising a sleeve configured to press fit in a first direction into a receptacle of a spay coating device, wherein the valve cartridge is configured to fit in a second direction into the receptacle, wherein the second direction is opposite from the first direction.

* * * * *